US007413319B2

(12) United States Patent
Longoria et al.

(10) Patent No.: US 7,413,319 B2
(45) Date of Patent: Aug. 19, 2008

(54) METHOD AND SYSTEM FOR UNDERWATER LIGHT DISPLAY

(76) Inventors: Jose Longoria, 8325 SW. 108th St., Miami, FL (US) 33156; Loren T Taylor, 40 Delwood Ave., Chatham, NJ (US) 07928; Traci Heather Feldman, 4136 E. Pullman Rd., Cave Creek, AZ (US) 85331

( * ) Notice: Subject to any disclaimer, the term of this patent is extended or adjusted under 35 U.S.C. 154(b) by 0 days.

(21) Appl. No.: 11/468,126

(22) Filed: Aug. 29, 2006

(65) Prior Publication Data

US 2007/0230161 A1 Oct. 4, 2007

Related U.S. Application Data

(60) Provisional application No. 60/744,031, filed on Mar. 31, 2006.

(51) Int. Cl.
*F21V 33/00* (2006.01)

(52) U.S. Cl. ..... 362/101; 362/267; 362/363

(58) Field of Classification Search ..... 362/35, 362/101, 237, 240, 242, 244, 246, 251, 267, 362/269, 318, 363; 239/18, 19, 20; 441/13, 441/16; 43/17.5
See application file for complete search history.

(56) References Cited

U.S. PATENT DOCUMENTS 1,670,816 A * 5/1928 Lewis ..... 362/35
3,626,173 A 12/1971 Harvey
3,693,278 A * 9/1972 Mahone ..... 43/17.5
3,748,457 A 7/1973 Balitzky et al.
3,833,955 A 9/1974 Hulbert, Jr.
4,088,880 A 5/1978 Walsh
4,394,716 A 7/1983 Campagna et al.
4,763,126 A * 8/1988 Jawetz ..... 441/16
4,779,174 A 10/1988 Staten et al.
D322,489 S 12/1991 Parker
5,231,781 A * 8/1993 Dunbar ..... 43/17.5
5,934,796 A 8/1999 Quereau
6,203,173 B1 3/2001 Duff et al.
6,220,718 B1 4/2001 Burgess
6,247,827 B1 6/2001 Carter
6,341,874 B1 * 1/2002 Rubin ..... 362/800

(Continued)

OTHER PUBLICATIONS

P3 International Corporation, Sol-Mate Floating Light, On sale at least as early as Jul. 2002, Attached is a web site image of the product as currently being sold.

(Continued)

*Primary Examiner*—Y M. Lee
(74) *Attorney, Agent, or Firm*—Snell & Wilmer LLP

(57) ABSTRACT

An underwater light display system for providing a decorative light display on the surface of a container holding a body of water and/or objects located within a body of water is provided. An exemplary system comprises a shell and a light assembly. The shell comprises a bottom and a top portion. In accordance with an exemplary embodiment, the light assembly is preprogrammed to produce variable light patterns and is secured to the interior surface of the top portion so as to direct light downward. In accordance with an exemplary embodiment, the light assembly may further comprise a plurality of lenses configured to direct light. In accordance with an exemplary embodiment, the light assembly further comprises a weight having a lens configured to direct light.

24 Claims, 7 Drawing Sheets

U.S. PATENT DOCUMENTS

| | | | | |
|---|---|---|---|---|
| 6,502,953 | B2 | 1/2003 | Hajianpour | |
| 6,550,928 | B1 * | 4/2003 | Lin | 362/35 |
| 6,655,812 | B2 | 12/2003 | Parker et al. | |
| 2004/0027831 | A1 * | 2/2004 | Huang | 362/363 |

OTHER PUBLICATIONS

Intermatic, Inc., Floating Pool/Spa Light, On sale at least as early as Aug. 2002, Attached is a web site image of the product as currently being sold.

* cited by examiner

METHOD AND SYSTEM FOR UNDERWATER LIGHT DISPLAY

CROSS-REFERENCE TO RELATED APPLICATIONS

This application claims priority to and benefit of U.S. Provisional Application No. 60/744,031, entitled "Method and System for Underwater Light Display" and filed on Mar. 31, 2006.

FIELD OF THE INVENTION

The invention generally relates to systems and methods for providing an underwater light display, such as on the surface of a container that holds a body of water, and or the surface of objects within the body of water.

BACKGROUND OF THE INVENTION

Water recreation has become a favorite pastime. As such, swimming pools, ponds, spas/jacuzzis and the like have become commonplace in residences and businesses, such as hotels. As the popularity of swimming pools and ponds have increased, it has become desirous to find ways to enhance their beauty and festive ambience. Prior art lighting systems for swimming pools, ponds, spas/jacuzzis are rigid and/or quite limited in their ability to provide unique underwater light displays to achieve enhanced ambience.

SUMMARY OF THE INVENTION

In accordance with various aspects of the present invention, a method and system for underwater light display provides a decorative and/or ornamental light display on a surface of a container holding a body of water, and/or on a surface of objects within the body of water.

In accordance with an exemplary embodiment, an underwater light display system comprises a shell and a light assembly that is located inside the shell. The shell can comprise various shapes and configurations, including for example, a hemispherical, translucent shell. In exemplary embodiments, the shell can comprise a resealable, waterproof top portion to allow access to the light assembly and/or a plurality of embedded lenses to direct the light generated by the light assembly.

In an exemplary embodiment, the light assembly comprises a light source, e.g., an LED light source, a battery power source and a control system configured to produce a variety of light shows when the light assembly is activated. In an exemplary embodiment, the light assembly is secured to an interior surface of a top portion of the shell so that light produced by the light assembly shines downward through a translucent portion of the shell to the surface of a container holding a body of water, and/or on the surface of objects within the body of water.

In accordance with an exemplary embodiment, the surface of a container holding a body of water, such as a pool, act as a "movie screen" reflecting the light generated by the underwater light display system and thereby creating a variable light pattern.

BRIEF DESCRIPTION OF THE DRAWINGS

The subject matter of the invention is particularly pointed out and distinctly claimed in the concluding portion of the specification. The invention, however, both as to structure and method of operation, may best be understood by reference to the following description taken in conjunction with the claims and the accompanying drawing figures, in which like parts may be referred to by like numerals:

DETAILED DESCRIPTION

The description that follows is not intended to limit the scope, applicability, or configuration of the invention in any way; rather, it is intended to provide a convenient illustration for implementing various embodiments of the invention. As will become apparent, various changes may be made in the function and arrangement of the elements described in these embodiments without departing from the scope of the invention. It should be appreciated that the description herein may be adapted to be employed having different shaped shells, top portions, and lighting systems and the like and still fall within the scope. Thus, the detailed description herein is presented for the purpose of illustration only and not of limitation.

That being said, exemplary embodiments of an underwater light system are provided. Generally, an underwater light system is any system that is capable of providing a decorative light display on the surface of a container holding a body of water, such as a pool bottom or sides, and/or on the surface of objects within the body of water. In an exemplary embodiment, an underwater light display system comprises a shell and a light assembly.

Figure 1:
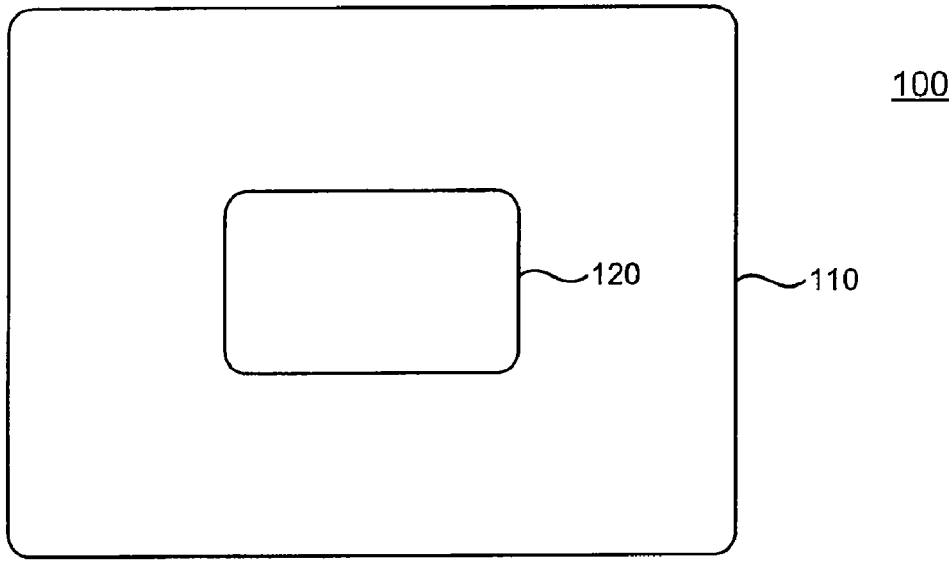
FIG. 1 is an exemplary embodiment of an underwater light display system.

Turning now to the Figures in which like reference characters indicate corresponding elements throughout the several views, FIG. 1 shows an exemplary embodiment of an underwater light display system 100 comprising shell 110 and light assembly 120.

Shell 110 is any structure that is capable of containing light assembly 120, e.g., to protect from water contact or other interference, and permits the passage of at least some light generated by light assembly 120 to the surface of a container holding a body of water, and/or on the surface of objects within the body of water.

In an exemplary embodiment, shell 110 is substantially hemispherical. However, those skilled in the art will appreciate that shell 110 may be any convenient shape such as spherical, cylindrical, rectangular, and/or the like and still fall within the scope. Furthermore, shell 110 may comprise any decorative shape, such as, for example, lilies, frogs, flowers, and/or the like.

In an exemplary embodiment, shell 110 may be substantially hollow in order to decrease the density of underwater light display system 100 and thereby increasing the buoyancy, allowing system 100 to float. However, in other exemplary embodiments, shell 110 may be substantially solid depending on the desired buoyancy of underwater light display system 100.

In accordance with an exemplary embodiment, underwater light display system 100 floats on or along the surface of a body of water. In accordance with another exemplary embodiment, underwater light display system may be adjusted to float at a desired depth by adding water to the interior of shell 110 to offset the buoyancy of the water. In another exemplary embodiment, underwater light display system 100 may be configured to set on the bottom of a body of water, or on the surface of objects beneath the water by increasing the density of system 100 to be greater than the density of water.

Furthermore, in an exemplary embodiment, shell 110 may be made of a low density material to increase the buoyancy of the underwater light display system. For example, shell 110 may comprise blow-molded plastic. However, it will be appreciated by one of ordinary skill in the art that shell 110 may be made of any material, such as glass and/or the like, that is capable of blocking or otherwise preventing the passage of water to an interior of shell 110.

In an exemplary embodiment, shell 110 may be substantially translucent in order to allow light to pass from the interior of underwater light display system 100 to the surface of a container holding a body of water. However, in various exemplary embodiments, shell 110 may be any degree of opaqueness that permits the passage of at least some light. For example, shell 110 may be tinted, semi-opaque, and/or the like to create a variety of lighting effects. In addition, shell 110 may comprise substantially all of its structure with such a substantially translucent configuration, or any smaller portions thereof, to allow light to pass through.

As shown in FIG. 1, shell 110 may be a one portion design. However, as shown in an exemplary embodiment in FIG. 2, shell 210 of underwater light display system 200 may comprise a bottom portion 215 and a resealable top portion 225. Resealable top portion 225 is any structure that is capable of mating with bottom portion 215 to create a watertight seal and permits a user to access the interior of shell 210. Resealable top portion 225 can comprise various types of materials and surfaces, e.g., translucent, tinted and/or opaque, or the same or different material as bottom portion 215. In accordance with an exemplary embodiment, top portion 225 comprises a textured top section configured to protect a lighting assembly from exposure to sunlight. For example, top portion 225 may comprise a polypropylene-type plastic, or any other material capable of performing the intended functions of top portion 225.

Figure 2:
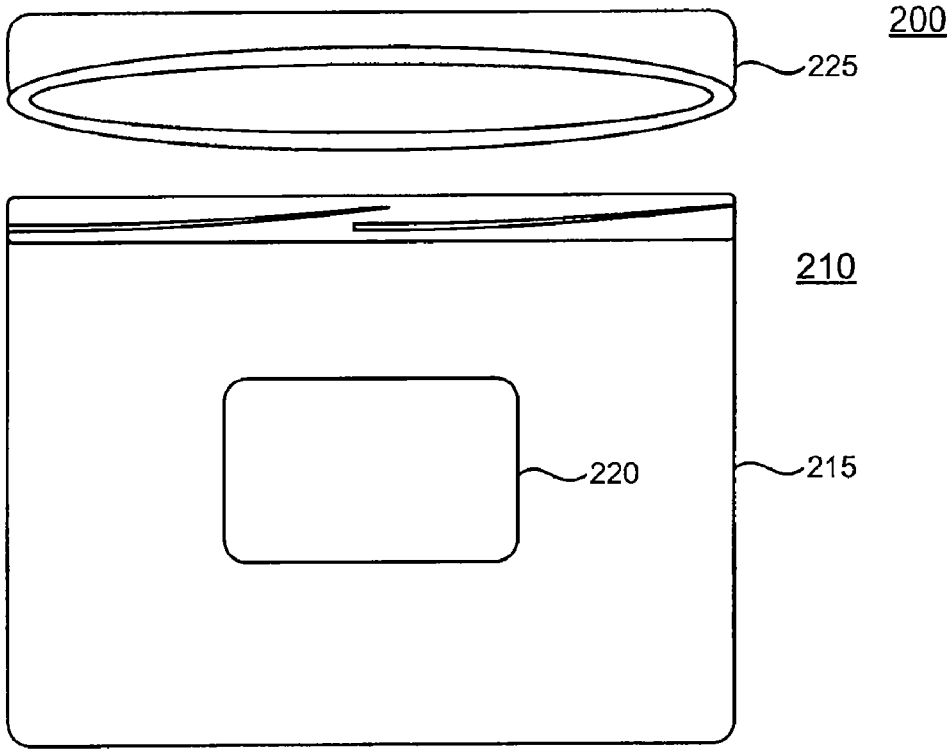
FIG. 2 is an exemplary embodiment of an underwater light display system having a two-portion design.

As shown in an exemplary embodiment in FIG. 2, top portion 225 is substantially flat. However, in various exemplary embodiments, top portion 225 may be any shape suitable for mating with bottom portion 215.

In an exemplary embodiment, top portion 225 may be configured to be screwed on to bottom portion 215. However, in accordance with various other exemplary embodiments, any method of or configuration for attaching top portion 225 to bottom portion 215 now known or hereinafter devised, such as press-fitting, snapping on and/or clamping to and the like, may be used.

In accordance with an exemplary embodiment, an underwater light display system may comprise one or more lighting effects. A lighting effect is any structure capable of directing, reflecting, refracting, focusing, defocusing and/or distorting light.

Figure 3:
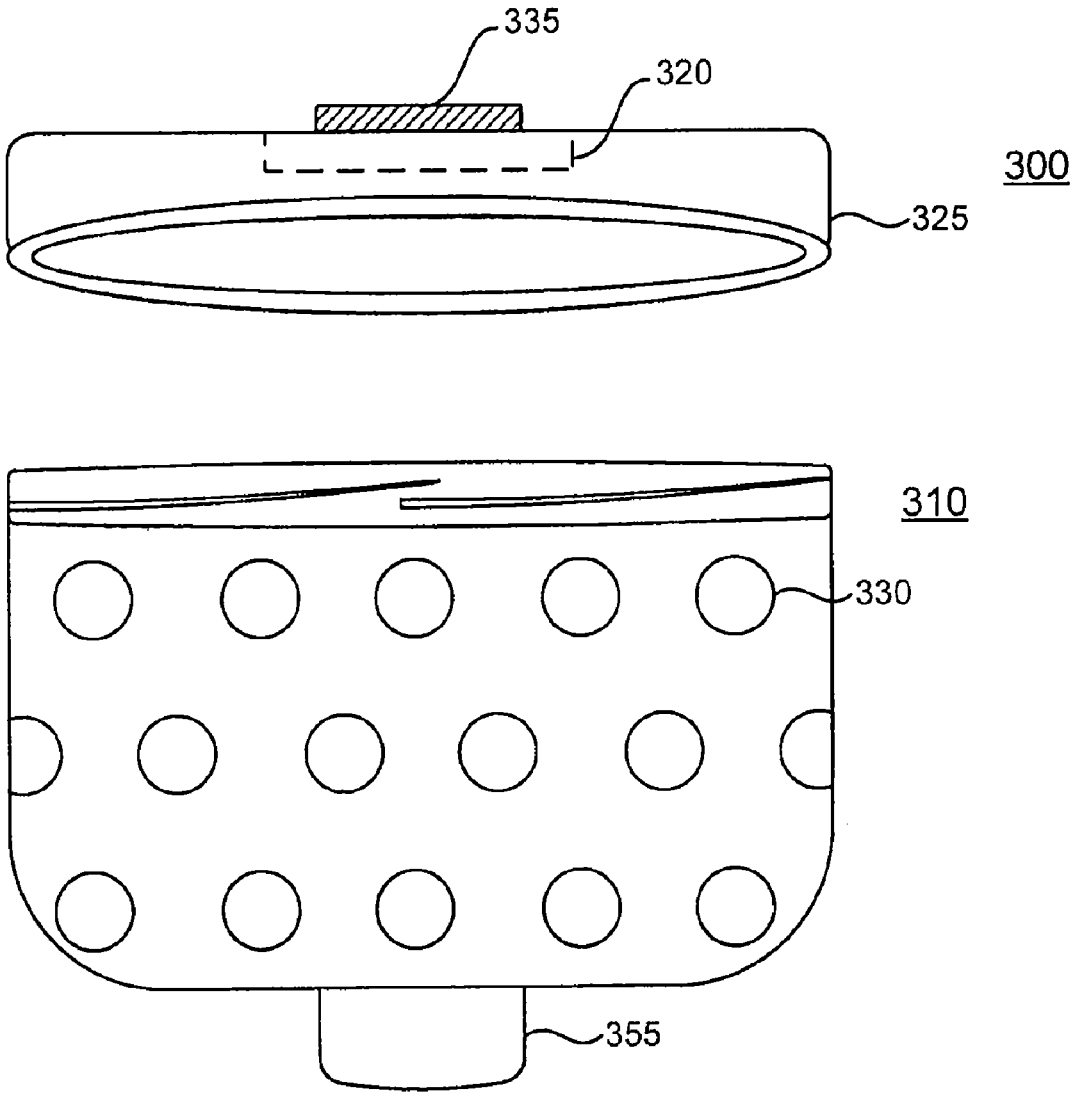
FIG. 3 is an exploded view of an exemplary embodiment of an underwater light display system comprising lenses.

For example, as shown in FIG. 3, shell 310 can comprise one or more lenses to focus, defocus, refract, or otherwise direct light provided by light assembly 320 through a surface of shell 310 to create variable light patterns.

In accordance with an exemplary embodiment, lenses 330 may be circular to create a light pattern on the surface of a container holding a body of water that is a series of expansive rings and/or circles of light. However, lenses 330 may also be configured to create any desired size or shape to create an endless variety of light patterns on the surface of a container holding a body of water. For example, lenses 330 may be configured to create dots, stars, characters, letters to spell out a message, any combination of the above, and/or the like. Furthermore, in an exemplary embodiment, the shapes may be configured to be in any desired degree of focus, refraction or direction.

Lenses 330 can comprise various types of materials for focusing, defocusing, refracting, or otherwise directing light. For example, lenses 330 can comprise acrylic materials, ABS or other translucent-like plastics, glass or any other configuration for focusing, defocusing, refracting, or otherwise directing light.

Lenses 330 can be suitably glued or otherwise affixed within or onto the exterior surface of shell 310. For example, lenses 330 may also be mounted to the interior or exterior surface of shell 310 using any now known or hereinafter devised attachment mechanism or methodology. Lenses 330 can also be integrally formed within the exterior surface of shell 310. In an exemplary embodiment, lenses 330 are suitably embedded in shell 310 so as to be substantially flush with an exterior surface of shell 310. In accordance with another exemplary embodiment, lenses 330 may be embedded in the surface of shell 310 so as to protrude from the surface.

In accordance with another exemplary embodiment, the shape of shell 310 may be configured such that lenses 330 are located one or more distances from a light assembly 320 to create a light pattern having varying degrees of focus, refraction, and/or direction.

Although an exemplary lighting effect can comprise lenses 330, exemplary lighting effects may comprise any configuration of reflecting, refracting, and/or otherwise distorting or directing light now known or hereinafter devised.

With reference again to FIG. 1, light assembly 120 may be any device capable of providing light. In accordance with an exemplary embodiment, a light assembly may comprise a light source connected to a power source.

In an exemplary embodiment, a light source is any device capable of generating light using electricity. For example, a light source may comprise one or more light emitting diodes (LEDs). LEDs are known in the art, and as such, an in-depth discussion is not provided. In such embodiments, any combination of colors, sizes, and intensities of LEDs may be used in conjunction with the light source. Instead of LEDs, any other type of light source or device capable of generating light may be utilized.

In an exemplary embodiment, the power source may be any device capable of producing electricity such that the light assembly produces light when the power source is connected to a light source. For example, a power source may comprise one or more standard, low voltage dry-cell or rechargeable batteries. However, any other device capable of producing electricity or other power may be used as a power source.

In accordance with another exemplary embodiment, the light assembly may further comprise a light programming mechanism or other control system. A light programming mechanism is any device capable of being programmed to produce one or more flashing or continuous light patterns by controlling and/or varying the output characteristics of the light source, such as, flash rate, frequency, period, and/or intensity.

In accordance with an exemplary embodiment, a light programming mechanism may comprise programmable circuitry or other like control system components. For example, a light programming mechanism may comprise an electrical circuit having various electronic components such as integrated circuits, processors and the like. Thus, a light programming mechanism may comprise any device capable of providing one or more light patterns and fall within the scope.

The light assembly may further comprise an activation device. An activation device is any device capable of activating and/or deactivating the light assembly. In an exemplary embodiment shown in FIG. 3, activation device 335 is a button that is located on the exterior surface of top portion 325 to facilitate user access. However, activation button 335 may also be located anywhere on underwater light display system 300.

In accordance with another exemplary embodiment, the light programming mechanism comprising a timer switch that can be selected by the individual, e.g., to operate for one hour, three hours, six hours or any other desired amount of time. Such a timer switch can be activated manually, e.g., by turning a dial or other switch device, or through programming of light programming control system. In addition to timing of operation, different light flashing programs can also be selected, either manually or through programming. In accordance with an exemplary embodiment, the light programming control system can also be configured with a remote control or other like device, e.g., an infrared control unit mounted within system 300 and configured to control light assembly 320, to allow individuals to remotely program or otherwise remotely operate system 300. As such, an exemplary light programming mechanism can create many different light flashing programs, which can generate a decorative light show on the surface of the perimeter containing a body of water and/or on the surface of objects within a body of water.

In an exemplary embodiment shown in FIG. 3, light assembly 320 may be configured proximate the inside of top portion 325 such that any light beams are substantially directed to shine downwards through shell 310 to the surface of a container holding a body of water, and/or on the surface of objects within a body of water. However, light assembly 320 may also be located anywhere within shell 310. While light assembly 320 can be configured in a stationary position within top portion 325, in accordance with an exemplary embodiment, light assembly 320 may be configured with a rotation platform, e.g., a motor and gearbox configuration, such that light assembly 320 rotates or translates within top portion 310 and/or such that individual lights within light assembly 320 can individually spin, rotate and/or translate, alone or in combination with each other and/or with the rotation or translation of the entire light assembly 320.

Figure 8:
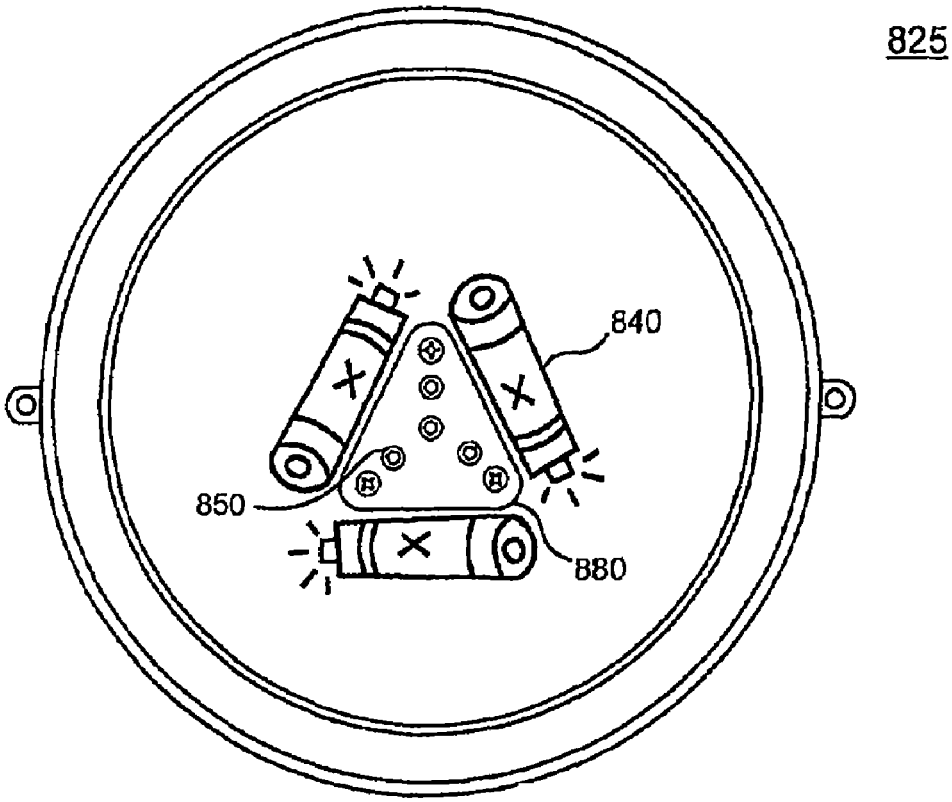
FIG. 8 is an exemplary embodiment showing a light assembly located on an inside top portion of the shell.

Accordingly, the light source, power source and control circuits may be configured in various manners. For example, with momentary reference to an exemplary embodiment shown in FIG. 8, the inside surface of a top portion 825 comprises LEDs 850, batteries 840, and a control circuit (not shown in FIG. 8). The control circuit is protected from water interference by protective plate 880. When the activation button (not shown) is activated, the control circuit that is connected to LEDs 850 produce one or more pre-programmed light displays that shine downwardly through the lenses 330 located in shell 310 to produce a decorative light show comprising a varying light pattern of multicolored rings on the surface a container holding a body of water, and/or on the surface of objects within the body of water.

In accordance with another embodiment, underwater light display system may further comprise a stabilization mechanism. A stabilization mechanism is any device capable of keeping the underwater light display system oriented in an upright position.

For example, as shown in FIG. 3, an exemplary stabilization mechanism may comprise a weight 355 to keep underwater light display system 300 oriented substantially upright. Such a weight 355 can be suitably enclosed within an integrally molded section of bottom portion 315, with weight 355 further comprising a lens portion to allow light to be focused, defocues or otherwise directed through. For example, when light assembly 320 is located on the inside of top portion 325, light will be continuously directed downward to the surface of a container holding a body of water, and/or on the surface of objects within the body of water.

Figure 4:
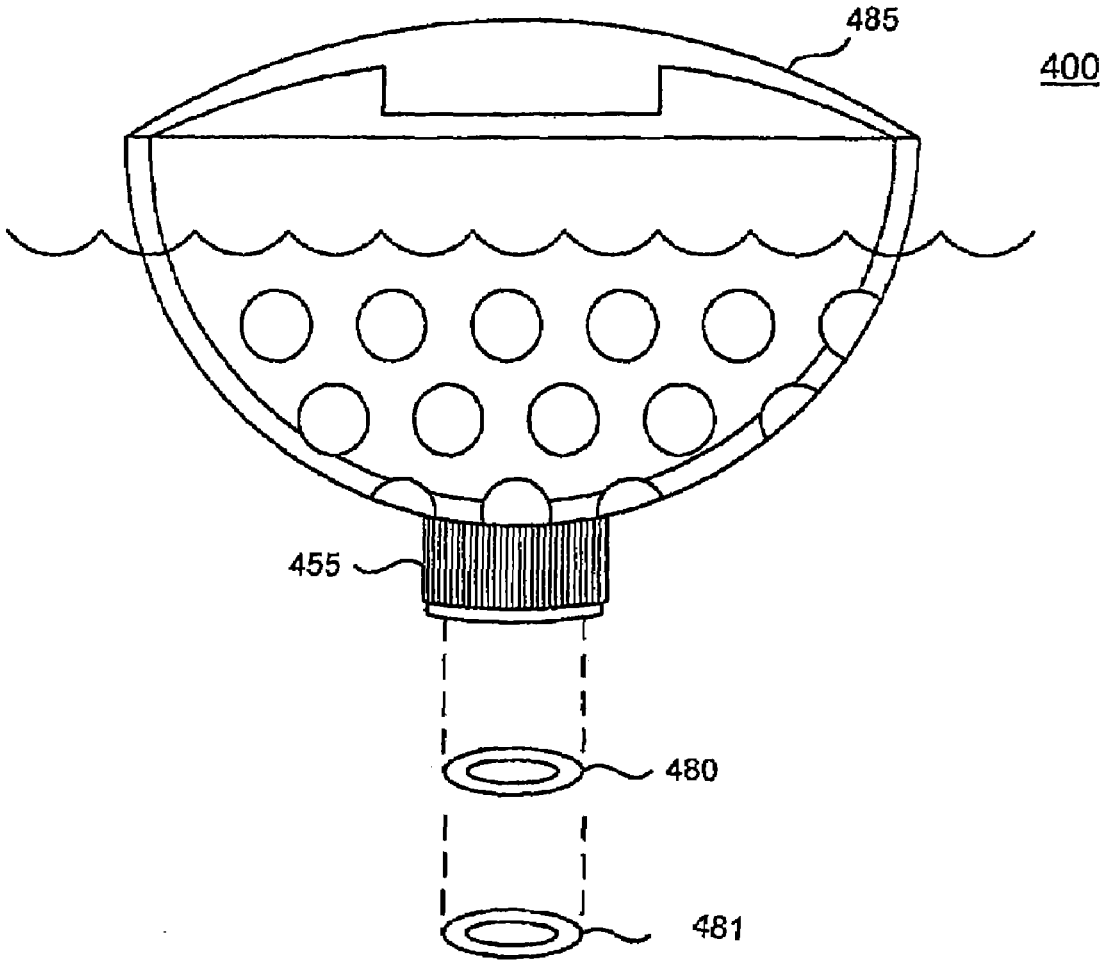
FIG. 4 is an exemplary embodiment showing a stabilization mechanism comprising a floating housing.
Figure 5:
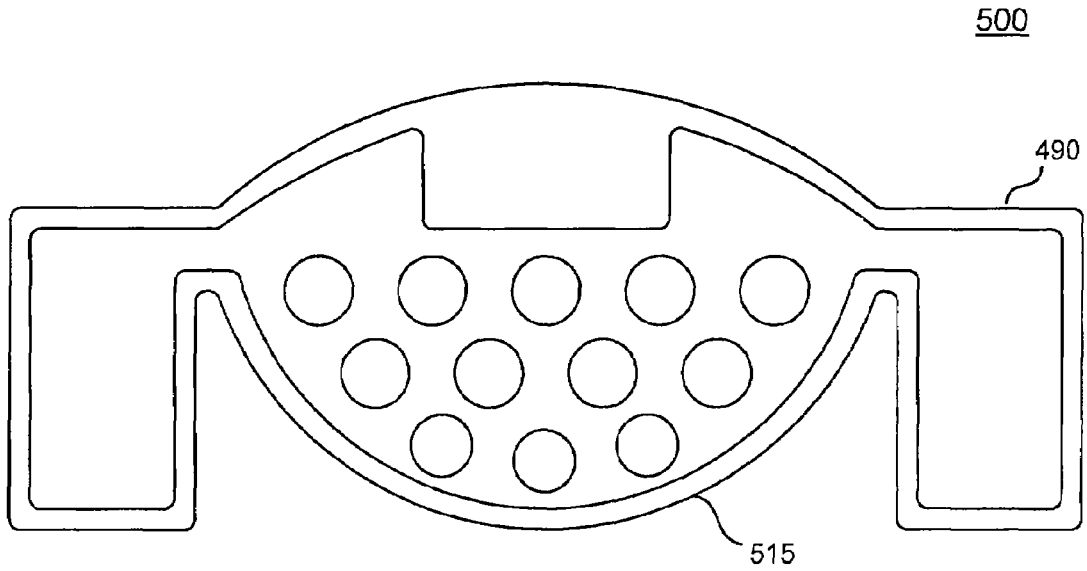
FIG. 5 is an exemplary embodiment showing a stabilization mechanism comprising a perimeter float.
Figure 6:
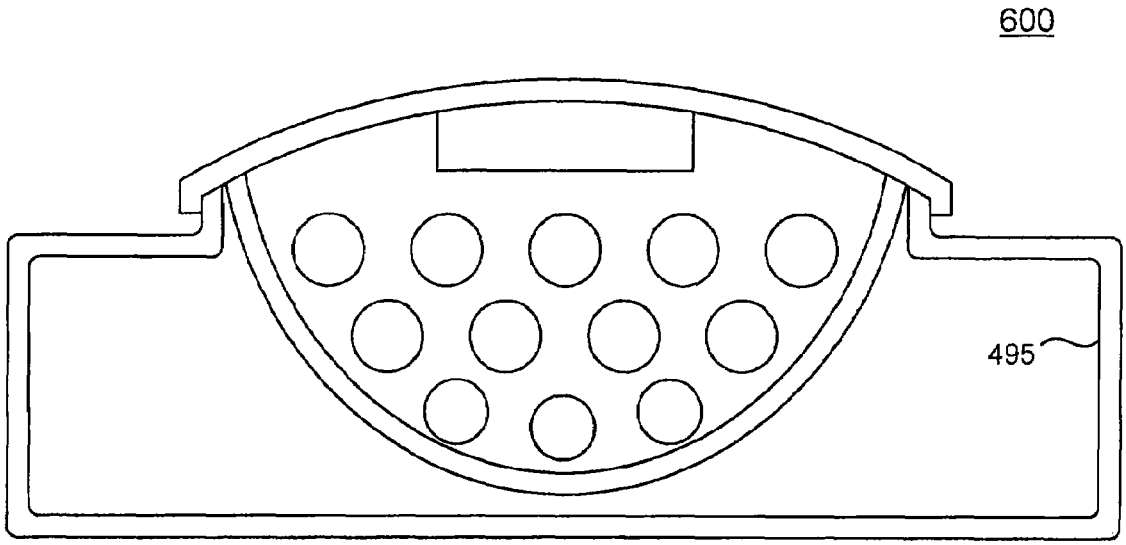
FIG. 6 is an exemplary embodiment showing the stabilization mechanism comprising a barge float.

In accordance with another exemplary embodiment as shown in FIG. 4, the stabilization mechanism may comprise a floating housing 485 configured to float right side up with a weight 455. Weight 455 may comprise one or more lenses 480 to refract light that is emanating outward from underwater light display system 400 and/or any other weight-bearing device. To facilitate testing of system 400, a pad 481 may be added beneath lens 480 to allow for drop-testing prior to shipment. In accordance with another exemplary embodiment as shown in FIG. 5, the stabilization mechanism may comprise a perimeter float 490 to act as a life preserver to keep underwater light display system 500 afloat and oriented substantially upright. In accordance with another exemplary embodiment as shown in FIG. 6, the stabilization mechanism may comprise a substantially translucent barge floater 495 to keep underwater light display system 600 afloat and oriented upright. Accordingly, a stabilization mechanism may comprise any structure capable of maintaining underwater light display system oriented substantially upright or in an otherwise desired orientational position.

In accordance with an exemplary embodiment, the underwater light display system may be configured for use in any body of water. For example, the shell may also be configured to be of any size suitable for use in a standard-sized swimming pool. However, the shell may also be configured to be any desired size that is suitable to contain the light assembly within a chosen body of water, such as a pond, a lake, and/or the like.

In an exemplary embodiment, underwater light display system may be free to float untethered on the surface of a body of water, so as to create moving light patterns on the surface of a container holding a body of water, and/or the surface of any objects within the body of water. However, it will be appreciated that underwater light display system may also be fixed in a stationary position using any known or hereinafter devised tethering and/or anchoring means, such as a suction cup.

In accordance with an exemplary embodiment, the surface of the perimeter containing the body of water acts as a "movie screen" to reflect the light generated by the underwater light display system, so as to create a variable light pattern. In accordance with an exemplary embodiment, the reflected light may be also configured to be in any size or shape. For example, the reflected shapes may comprise any known shape such as, for example, dots, stars, characters, and/or letters arranged to spell out a message.

Figure 7:
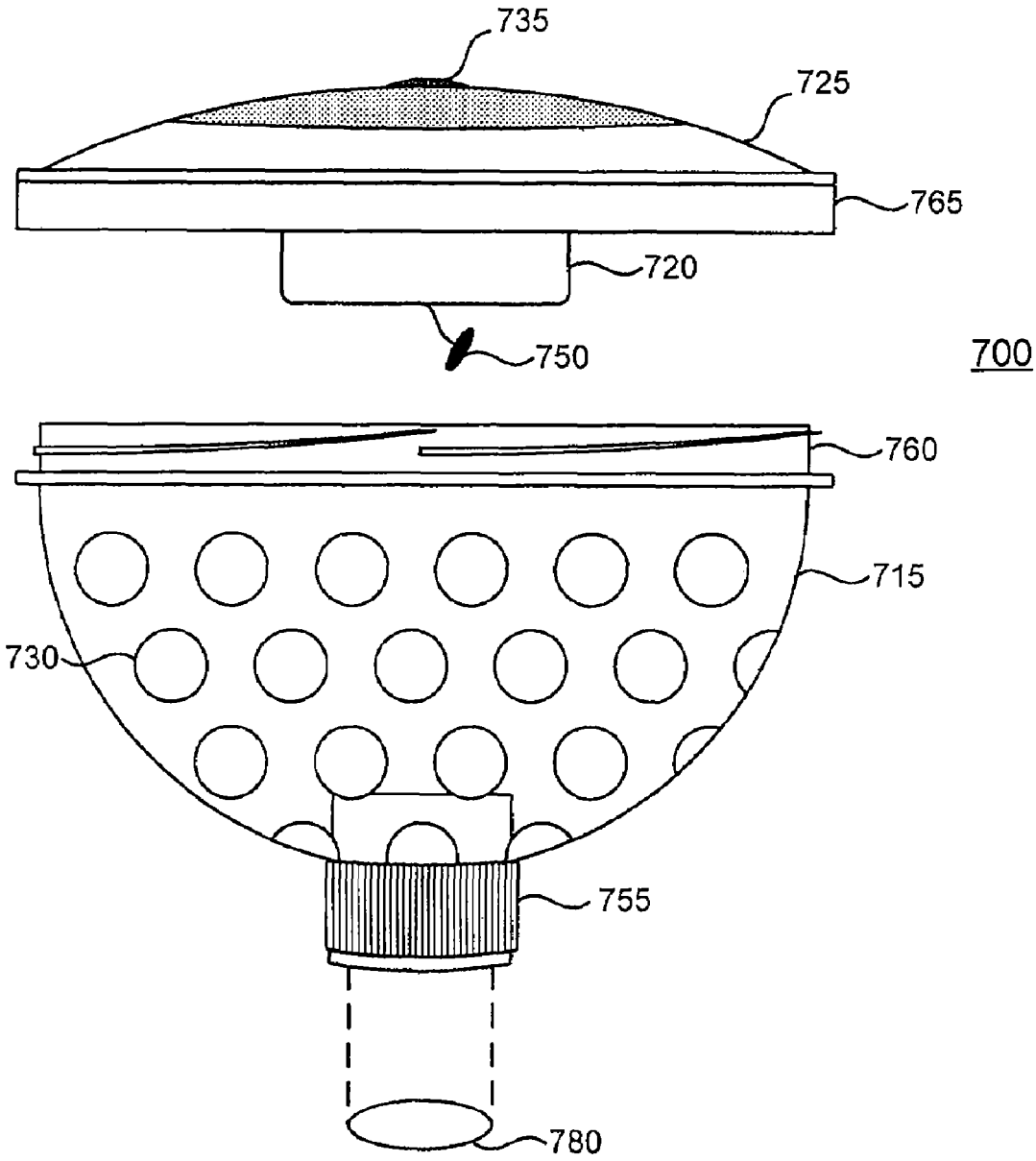
FIG. 7 is another exploded view of an exemplary embodiment.

Referring to FIG. 7, underwater light display system 700 comprises a hemispherically-shaped bottom portion 715 and top portion 725. Hemispherically shaped bottom portion 715 comprises a plurality of lenses 730 similar to those described in the embodiment of FIG. 3. Bottom portion 715 further comprises a weight 755 to keep underwater light display system 700 oriented substantially upright. As shown, weight 755 comprises one or more lenses 780 to refract light beaming downwards or sideways from lighting mechanism 720. A peripheral edge 760 of bottom portion 715 is stepped radially inward and has a series of grooves to create a waterproof seal when mated with a peripheral edge 765 of top portion 725. Top portion 725 further comprises an activation button 735 to activate the light programming mechanism 720. Lighting mechanism 720 comprises one or more LEDs 750.

Thus, a new and improved underwater light display system has been described above with reference to various exemplary embodiments. However, those skilled in the art will recognize that changes and modifications may be made to the exemplary embodiments without departing from the scope of the present invention. For example, the various components may be configured in alternate ways depending upon the particular application or in consideration of cost. These and other changes or modifications are intended to be included within the scope of the present invention, as set forth in the following claims.

The invention claimed is:

1. A light display system for creating a decorative light pattern on a surface within a body of water, said light display system comprising:

a shell comprising a bottom portion and a top portion, said top portion configured to be opaque and removably sealable with said bottom portion;

a light assembly located within said shell, wherein said light assembly focuses light on the surface within the body of water in one or more flashing or continuous patterns;

a plurality of lenses integrally formed within said bottom portion of said shell, wherein said plurality of lenses direct light produced by said light assembly on the surface within the body of water; and wherein said plurality of lenses define a buoyant surface of said bottom portion, wherein said top portion is buoyed above water and wherein substantially all of said plurality of lenses are located underwater.

2. A light display system of claim 1, further comprising a weight secured to said bottom portion of said shell.

3. A light display system of claim 2, wherein said weight is configured with a pad located beneath said weight to facilitate drop-testing.

4. A light display system of claim 1, wherein said bottom portion is substantially hemispherical.

5. A light display system of claim 1, wherein said bottom portion is substantially translucent.

6. A light display system of claim 1, wherein each of said plurality of lenses comprise a shape selected from a group consisting of dots, stars, characters, and letters.

7. A light display system of claim 1, wherein said light assembly comprises at least one light emitting diode.

8. A light display system of claim 1, wherein said light assembly comprises a control system configured for remote control of said light assembly.

9. A light display system of claim 1, wherein said light assembly comprises a rotation platform configured to facilitate at least one of rotational and translational movement of at least an entire light assembly or at least one light device within said light assembly.

10. A light display system for creating a decorative light pattern on surfaces in a body of water, said light display system comprising:

a shell comprising a bottom portion and a top portion, said top portion configured to be removably sealable with said bottom portion;

a light assembly located within said shell, wherein said light assembly is configured to produce light in one or more flashing or continuous patterns;

a plurality of lenses secured to said bottom portion of said shell, wherein said plurality of lenses are configured to direct light produced by said light assembly; and a weight secured to said bottom portion of said shell, wherein said weight comprises a lens configured to direct light.

11. A method of creating a light display on surfaces within a body of water, said method comprising the steps of:

providing a shell having a bottom portion and a top portion that is removably securable to said bottom portion;

providing a light assembly comprising a light emitting diode in said shell;

programming said light assembly to generate light in at least one flashing pattern and continuous pattern;

integrally embedding lenses in the surface of said bottom portion and not in the surface of said top portion of said shell, wherein said lenses are located a plurality of distances from said light assembly, and wherein said lenses are further aligned along more than a single plane through said surface; and directing said light of said at least one flashing pattern and continuous pattern through said lenses towards a bottom surface beneath a top surfaces of the body of water to generate the light display on said surface.

12. The method according to claim 11, further comprising configuring said shell to float on the surface of a body of water.

13. The method according to claim 11, further comprising providing a weight and securing said weight to the exterior of said shell.

14. The method according to claim 11, further comprising said light assembly to be secured to the interior surface of said top portion.

15. The method according to claim 14, further comprising configuring said light assembly to direct light downward.

16. The method according to claim 14, further comprising said light assembly to be configured for at least one of rotational or translational movement within said top portion.

17. The method according to claim 11, further comprising configuring said shell to be translucent.

18. A light display system for creating a decorative light display on the surface of objects beneath a top surface of a body of water, said light display system comprising:

a shell comprising a bottom portion and a top portion; and a light assembly secured to a rotation platform, wherein said rotation platform is secured to the interior surface of said top portion, wherein said light assembly is preprogrammed by an electrical light programming mechanism to produce light directed downward in a plurality of flashing or continuous patterns, wherein said a rotation platform is configured to facilitate rotational movement of said light assembly within said top portion, wherein said light directed downward creates said decorative light display on the surface of objects beneath said top surface of said body of water, and wherein said flashing or continuous patterns are independent of said rotational movement.

19. The light display system of claim 18, wherein said top portion comprises a textured section configured to minimize exposure of sunlight to said light assembly.

20. The light display system of claim 18, wherein said shell further comprises one or more lenses integrally formed in said bottom portion of said shell, wherein said lenses are configured to perform at least one of focusing, refracting or defocusing of light produced by said light assembly.

21. The light display system of claim 18, wherein the shape of said shell is selected from a group comprising at least one of a sphere, a lily, a frog and a flower.

22. The light display system of claim 18, said light display system further comprising at least one of a perimeter float or a barge floater.

23. A light display system for creating an underwater light display, said light display system comprising:

a top shell portion configured to substantially prevent light from passing through said top shell portion having a plurality of light devices being secured to an interior surface of said top portion and directing light from said plurality of light devices downward to create said underwater light display; and a bottom shell portion having a plurality of lenses further directing said light directed downward by said top portion from said plurality of light devices to create said underwater light display on a lower surface of a body of water, said bottom shell portion further comprising a buoyant configuration to maintain said plurality of lenses underwater and said top shell portion above water.

24. The system according to claim 23, wherein said plurality of light devices are configured for at least one of rotational or translational movement within said top portion.

* * * * *

UNITED STATES PATENT AND TRADEMARK OFFICE

CERTIFICATE OF CORRECTION

PATENT NO. : 7,413,319 B2
APPLICATION NO. : 11/468126
DATED : August 19, 2008
INVENTOR(S) : Jose Longoria et al.

It is certified that error appears in the above-identified patent and that said Letters Patent is hereby corrected as shown below:

In Claim 11, column 8, line 27, please delete "of said" and insert therefor --in said--.

In Claim 11, column 8, line 29, please delete "top surfaces" and insert therefor --top surface--.

In Claim 11, column 8, line 30, please delete "said surface" and insert therefor --said bottom surface--.

In Claim 12, column 8, line 32, please delete "a body" and insert therefor --the body--.

In Claim 18, column 8, line 58, please delete "said a rotation" and insert therefor --said rotation--.

Signed and Sealed this

Twenty-eighth Day of October, 2008

JON W. DUDAS
*Director of the United States Patent and Trademark Office*